US007612547B2

(12) United States Patent
Renous

(10) Patent No.: US 7,612,547 B2
(45) Date of Patent: Nov. 3, 2009

(54) SERIES VOLTAGE REGULATOR WITH LOW DROPOUT VOLTAGE AND LIMITED GAIN TRANSCONDUCTANCE AMPLIFIER

(75) Inventor: Claude Renous, Grenoble (FR)

(73) Assignee: STMicroelectronics S.A., Montrouge (FR)

( * ) Notice: Subject to any disclaimer, the term of this patent is extended or adjusted under 35 U.S.C. 154(b) by 284 days.

(21) Appl. No.: 11/621,488

(22) Filed: Jan. 9, 2007

(65) Prior Publication Data

US 2007/0188228 A1 Aug. 16, 2007

(30) Foreign Application Priority Data

Jan. 9, 2006 (FR) ..... 06 00143

(51) Int. Cl.
*G05F 1/575* (2006.01)

(52) U.S. Cl. ..... 323/280

(58) Field of Classification Search ..... 323/273, 323/280

See application file for complete search history.

(56) References Cited

U.S. PATENT DOCUMENTS

| | | | | |
|---|---|---|---|---|
| 6,225,857 | B1 | 5/2001 | Brokaw | 327/540 |
| 6,518,737 | B1 | 2/2003 | Stancscu et al. | 323/280 |
| 6,710,583 | B2 * | 3/2004 | Stanescu et al. | 323/280 |
| 7,218,082 | B2 * | 5/2007 | Walter et al. | 323/273 |
| 2003/0102851 | A1 * | 6/2003 | Stanescu et al. | 323/280 |
| 2006/0091866 | A1 * | 5/2006 | Tokumitsu et al. | 323/280 |

FOREIGN PATENT DOCUMENTS

| | | |
|---|---|---|
| EP | 1376294 | 1/2004 |
| EP | 1508847 | 2/2005 |
| EP | 1569062 | 8/2005 |

OTHER PUBLICATIONS

K.N. Leung and P.K.T Mok, "A Capacitor-Free CMOS Low-Dropout Regulator with Damping-Factor-Control Frequency Compensation," *IEEE Journal of Solid-State Circuits*, vol. 38, No. 10, pp. 1691-1702, Oct. 2003.

Rincon-Mora, G., et al., "Optimized Frequency-Shaping Circuit Topologies for LDO's," IEEE Transactions on Circuits and Systems—II: Analog and Digital Signal Processing, vol. 45, No. 6, Jun. 1998, pp. 703-708.

* cited by examiner

*Primary Examiner*—Jeffrey L. Sterrett
(74) *Attorney, Agent, or Firm*—Lisa K. Jorgenson; Eric M. Ringer; Seed IP Law Group PLLC

(57) ABSTRACT

A voltage regulation circuit intended to generate a regulated voltage for an electronic device, comprising: a transconductance amplifier based on a pair of MOS type differential amplifiers, said amplifier having a first input onto which a reference potential is applied and a second input onto which a counter reaction of said regulated voltage is input; a follower stage connected to the output from said transconductance amplifier; a MOS type transistor that will be used to make the output stage of the regulation circuit with a source connected to a first power supply potential. The transconductance amplifier comprises a resistive load 360 with a profile in K/gm, where gm is the transconductance coefficient of said input differential pair, said resistive load being connected to said first power supply potential.

21 Claims, 3 Drawing Sheets

SERIES VOLTAGE REGULATOR WITH LOW DROPOUT VOLTAGE AND LIMITED GAIN TRANSCONDUCTANCE AMPLIFIER

BACKGROUND OF THE INVENTION

1. Field of the Invention

This invention relates to electronic regulation circuits and particularly to a series voltage regulator with low dropout voltage.

2. Description of the Related Art

"Series" low DropOut (LDO) voltage regulators are frequently used for making battery powered circuits. Apart from their regulation function, they also switch unused electronic sub-circuits when necessary so as to reduce electrical consumption of the equipment. They are used jointly with switching power supplies to increase rejection of disturbances emitted by these same power supplies.

These circuits are used to make many mobile telephones on the market. Large efforts are made to increase the performances of these regulators, particularly in terms of load rejection and response to load variations. It is desirable to be able to create an output voltage with a precision of better than one percent, even for particularly low power supply voltages (less than 2 Volts).

LDO type regulation circuits are already known:

FIG. 1 shows an example of a first known system like that described in the publication "*Optimized Frequency-Shaping Circuit Topologies for LDOs*" by Gabriel A. Rincàon-Mora and Philip E. Allen, IEEE TRANSACTIONS ON CIRCUIT AND SYSTEMS-II: ANALOG AND DIGITAL PROCESSING No. 6, June 1998. This first circuit is based on a cascade with a differential amplifier 110 acting as error amplifier, a follower stage 120 (or inverter) and a PMOS transistor (in the example illustrated) 130 used for voltage regulation supplying a load 141-143. A counter-reaction chain materialized by resistive elements 170 and 180 is used for regulating the power supply voltage at the terminals of the drain of transistor 130. The differential amplifier 110 is loaded by a capacitor 150 making an order zero (0) pole, which gives a high gain in open loop.

FIG. 2 illustrates a second known circuit described particularly in document "*A Capacitor-Free CMOS Low-dropout Regulator with Dampling-Factor-Control Frequency Compensation*", Ka Nang Leung and Philip K., T. Mok. IEEE JOURNAL OF SOLID STATE CIRCUIT, VOL. 38, No. 10, October 2003. For reasons of clarity, elements functionally identical to the first circuit have the same references. A regulator based on a chain comprising a differential error amplifier 110, a follower or inverter stage 120, and the PMOS transistor 130 are once again present. As above, the error amplifier 110 is loaded by a capacitive load formed by the capacitors Cm1, CM2 and the DFC amplifier making a capacitor amplifier. The result is once again an order zero pole giving a high gain in open loop.

These two circuits, and in general circuits known according to the state of the art, introduce stability problems that are solved using appropriate pole splitting techniques. These techniques induce large transient responses during sudden current variations due to the large number of poles (in the Nyquist sense) in the slaving chain.

The result is loss of precision achieved in the regulator output voltage.

It is desirable to improve known regulation circuits, particularly for response transients to sudden variations in the current demand by the load.

BRIEF SUMMARY OF THE INVENTION

In one embodiment, a regulation circuit that is easy to manufacture and that considerably facilitates stabilization of the output voltage slaving chain.

Another embodiment includes a particularly stable low dropout series voltage regulator.

In one embodiment, a voltage regulation circuit comprises: a transconductance amplifier comprising a pair of MOS type transistors, said amplifier having a first input onto which a reference potential is applied and a second input onto which a counter reaction of said regulated voltage is input, and an output electrode; a follower stage connected to the output from said transconductance amplifier used to create an input to the MOS output transistor with a source connected to the power supply potential (Vdc)

a resistive load with a profile in K/gm, where gm is the transconductance coefficient of said input differential pair, said resistive load being connected to the power supply potential to which the source of said output transistor is connected.

In this way, it is assured that the transconductance amplifier has a limited gain regardless of variations of the coefficient gm of the pair of MOS type transistors. This pushes the intrinsic pole of this transconductance amplifier well beyond the pole induced by the MOS output transistor compensation capacitor, and finally considerably facilitates compensation of the circuit and reduces transients generated by sudden variations of the load current.

Preferably, the output transistor is a PMOS type transistor with a source connected to the positive power supply potential and the resistive load in K/gm comprises at least one MOS type transistor connected in resistive load.

In one particular embodiment, the resistive load in K/gm comprises a fixed resistance, which acts as a stop and which is in parallel with at least one MOS type transistor.

In another embodiment, a transconductance amplifier comprises:

a first MOS type transistor with a gate, source and drain, a first reference potential (Vref) being input to the gate, and the source being connected to a first current source, a second MOS type transistor with a gate, source and drain, a fraction of the output voltage from the regulator being input to the gate through a counter reaction circuit, the source being connected to said first current source;

a second current source connected between said first power supply potential (Vdc) and the drain of said first MOS transistor;

a third current source connected between said first power supply potential (Vdc) and the drain of said second MOS transistor;

a third MOS transistor comprising a source connected to the drain of said first MOS transistor and to said second current source; said third transistor being provided with a gate into which a second reference potential (Vref2) is input;

a fourth MOS transistor comprising a source connected to the drain of said second transistor and to said third current source; said fourth transistor being provided with a gate into which the second reference potential (Vref2) is input;

a fifth MOS transistor with a source, a gate and a drain, said source of said fifth MOS transistor being connected to a second power supply potential (GND), said drain of said fifth MOS transistor being connected to the drain of said third transistor, and forming the output electrode of said transconductance amplifier;

a sixth MOS transistor with a source, a gate and a drain, said source of said sixth MOS transistor being connected to said second power supply potential (GND), said drain of said sixth MOS transistor being connected to the drain of said fourth transistor, and to the gates of said fifth and sixth transistors.

Preferably, a follower stage comprises:

a seventh MOS type transistor comprising a gate, a source and a drain, said gate of said seventh transistor being connected to said output electrode of said transconductance amplifier and said drain of said seventh transistor being connected to a fourth current source;

a bipole transistor comprising a base, an emitter and a collector, the base of the bipole transistor being connected to the drain of said seventh MOS transistor, the emitter being connected to said second power supply potential (GND), and the collector being connected to the source of said seventh MOS transistor and to a first electrode of a resistance with a second electrode connected to said first power supply potential (Vdc).

Embodiments of the invention can also be used to make a battery powered portable switching apparatus, particularly such as a mobile telephone including a voltage regulation circuit comprising:

a transconductance amplifier based on a pair of MOS type differential transistors, said amplifier comprising a first input into which a reference potential is input and a second input into which a counter-reaction of said regulated voltage is input;

a follower stage connected to the output from said transconductance amplifier;

a MOS type transistor that will be used to make the output stage of the regulation circuit with a source connected to a first power supply potential (Vdc); wherein said transconductance amplifier comprises a resistive load with a profile in K/gm, where gm corresponds to the transconductance coefficient of said differential input pair, said resistive load being connected to said first power supply potential (Vdc).

BRIEF DESCRIPTION OF THE SEVERAL VIEWS OF THE DRAWINGS

Other special features, purposes and advantages of the invention will become clearer after reading the description and appended figures given below, simply as non-limitative examples, wherein.

DETAILED DESCRIPTION OF THE INVENTION

Figure 3:
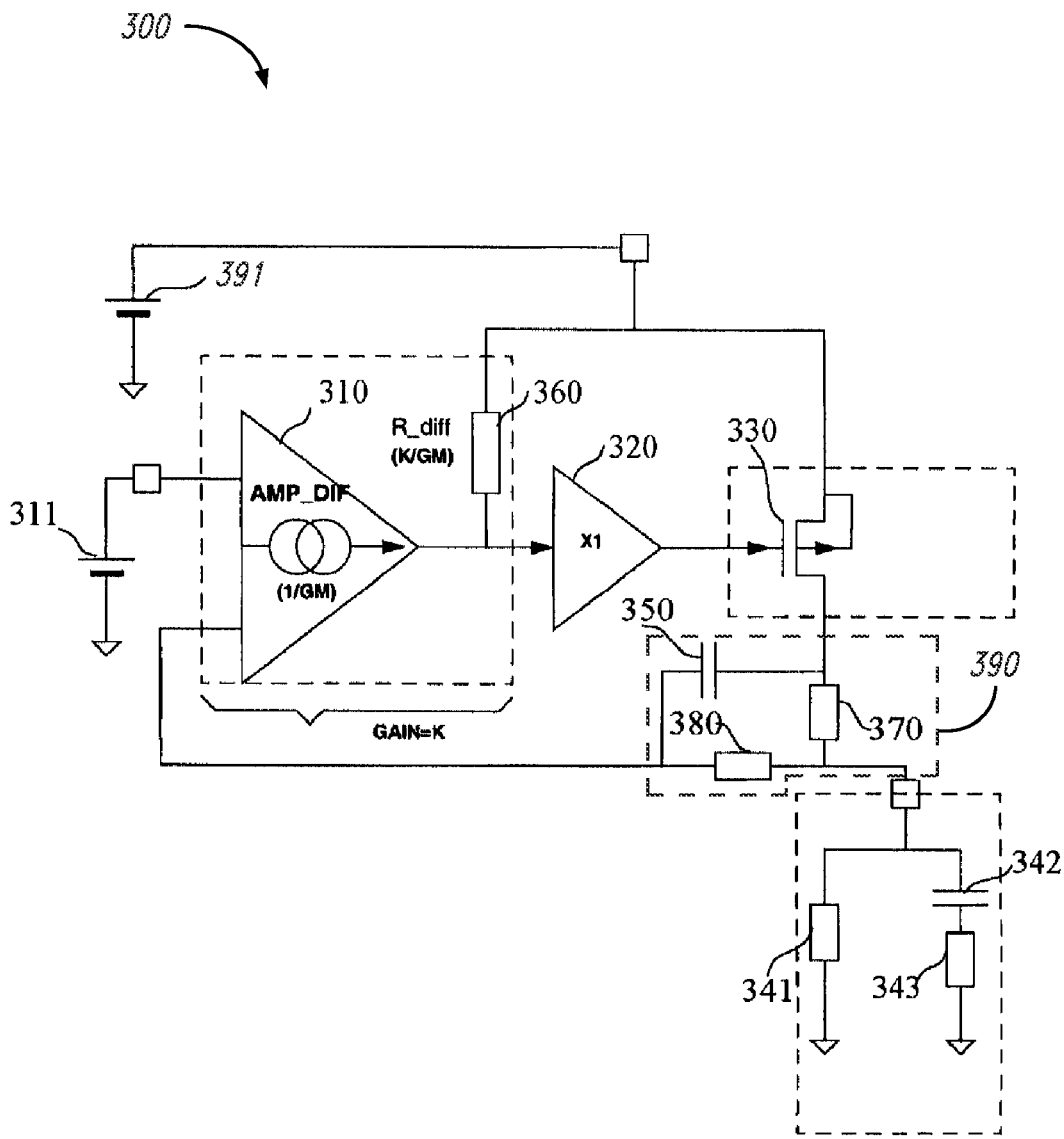
FIG. 3 shows a regulation circuit according to one illustrated embodiment.

FIG. 3 illustrates the principle used to make a low dropout voltage regulator according to an embodiment. The circuit is particularly suitable for making battery powered electronic circuits, and particularly low voltage circuits like those used for mobile telephones.

The circuit according to the illustrated embodiment is used to convert from the compensation capacitance in the input stage present in known regulation circuits, and that induces problems of unwanted transient responses if there is a sudden variation in the load current.

FIG. 3 shows a regulation circuit 300 that comprises a differential transconductance amplifier 310, a follower stage 320, and a transistor 330. The follower stage 320 is connected to the output of the transconductance amplifier 310 and to the gate of the transistor 330. The transconductance amplifier 310 is used as an error amplifier that receives a reference potential at its input (represented by element 311) used to fix the output potential to be regulated and a fraction of this output potential through a counter-reaction network 390, which comprises a compensation capacitor 350 in parallel with a set of two resistive passive elements 370 and 380.

gm is the transconductance coefficient of the circuit 310.

The transconductance amplifier can be made using any MOS type or other type of integrated or discrete amplifier circuit that can be used to obtain an output current proportional to the difference (error) between its two inputs.

In one preferred embodiment, the transconductance amplifier is made using a differential amplifier comprising MOS type transistors.

Figure 1:
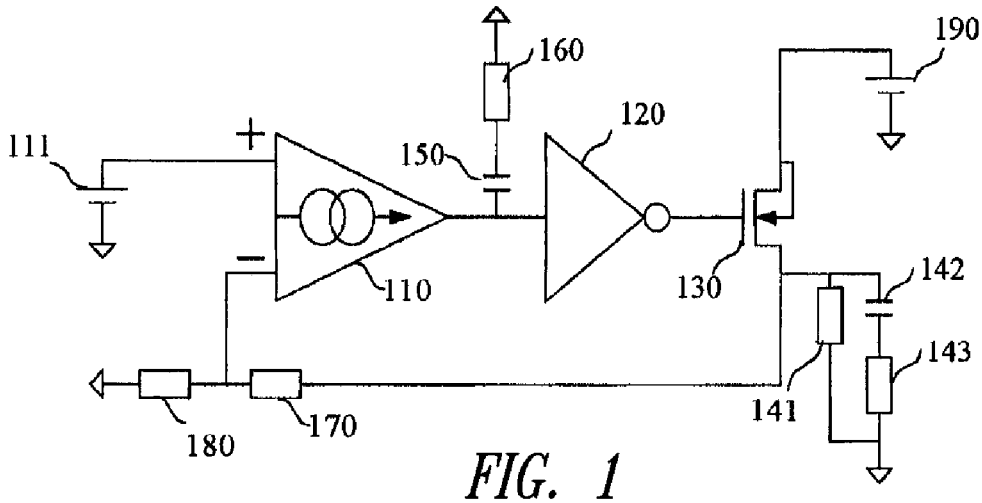
FIG. 1 (Prior Art)
FIG. 1 illustrates a first known low dropout voltage regulation circuit.
Figure 2:
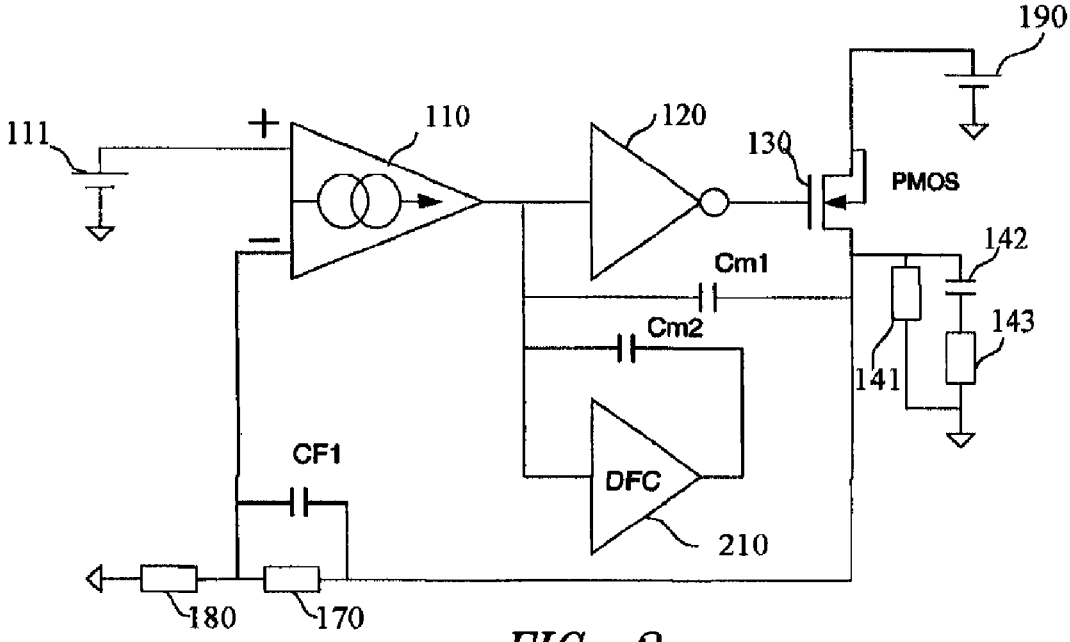
FIG. 2 (Prior Art)
FIG. 2 illustrates a second known low dropout voltage regulation circuit.

Unlike known circuits, the amplifier circuit 310 is loaded by a resistive type load 360 so as to limit the output gain of the error amplifier stage. This prevents an order 0 pole like that used in known circuits from being set-up, as described in FIGS. 1 and 2 mentioned above.

In practice, the gain of the stage is limited to 30 or 40 dB, unlike in known circuits in which the gain can easily be as high as 100 dB.

Preferably, a resistive component will be chosen for the resistive element 360 with a resistance equal to K/gm, in which K is a constant and gm is the transconductance coefficient of the error amplifier.

On the output side of the follower stage, the circuit comprises a MOS transistor for which the gate is controlled by the output voltage from the follower stage. The source of the MOS transistor is connected to the power supply potential—usually fixed by the battery or the output from a DC/DC converter such as a switching power supply 391. The drain of the MOS transistor outputs the regulator output potential, accessible at a load represented by two resistive elements 341 and 343 and a capacitive element 342. As can be seen in the figure, a counter-reaction network 390 comprises a compensation capacitor 350 connected between the drain of the MOS transistor and the second input of the error amplifier circuit 310, in parallel with two resistive elements 370 and 380 in series. The load 341-342—343 is connected to the midpoint of elements 370 and 380.

As can be seen, due to the presence of the load 360 equal to K/gm, the regulation circuit 300 only comprises a main pole which is fixed by the output from the MOS transistor 330, the counter reaction network 390, and particularly the compensation capacitor 350.

In one particular embodiment, an element of the same nature as the amplifier elements located in the error amplifier 310 and integrated in the same semiconducting substrate is used to make the resistive load 360, so that it can be subjected to the same temperature variations. Thus, if the error amplifier 310 uses a pair of MOS transistors to make the differential stage, then the load 360 is made using MOS transistors as well, installed as a resistive load varying with the temperature and the inrush current.

In this way, even with large temperature variations and variations in the load 341-342-343, it is assured that the gain of the amplifier stage 310 and 360 remains limited to K.

For a fixed gain-band product of the error amplifier stage 310, it is found that the resistive load 360 with a profile in K/gm can assure a relatively high switching frequency for the input stage 310 and consequently prevents phase rotation due to the order 0 pole. Consequently, this phase rotation occurs after the phase rotation introduced by the compensation capacitor 350, which makes it easy to stabilize the regulation circuit.

Consequently, the main pole of the regulation circuit is fixed essentially by the capacitor 350 and no longer by capacitors intrinsic to the input amplifier stage 310 and that are difficult to control.

Furthermore, it is found that the transients related to sudden load variations, which can reduce the precision of the regulation circuit, are avoided.

Figure 4:
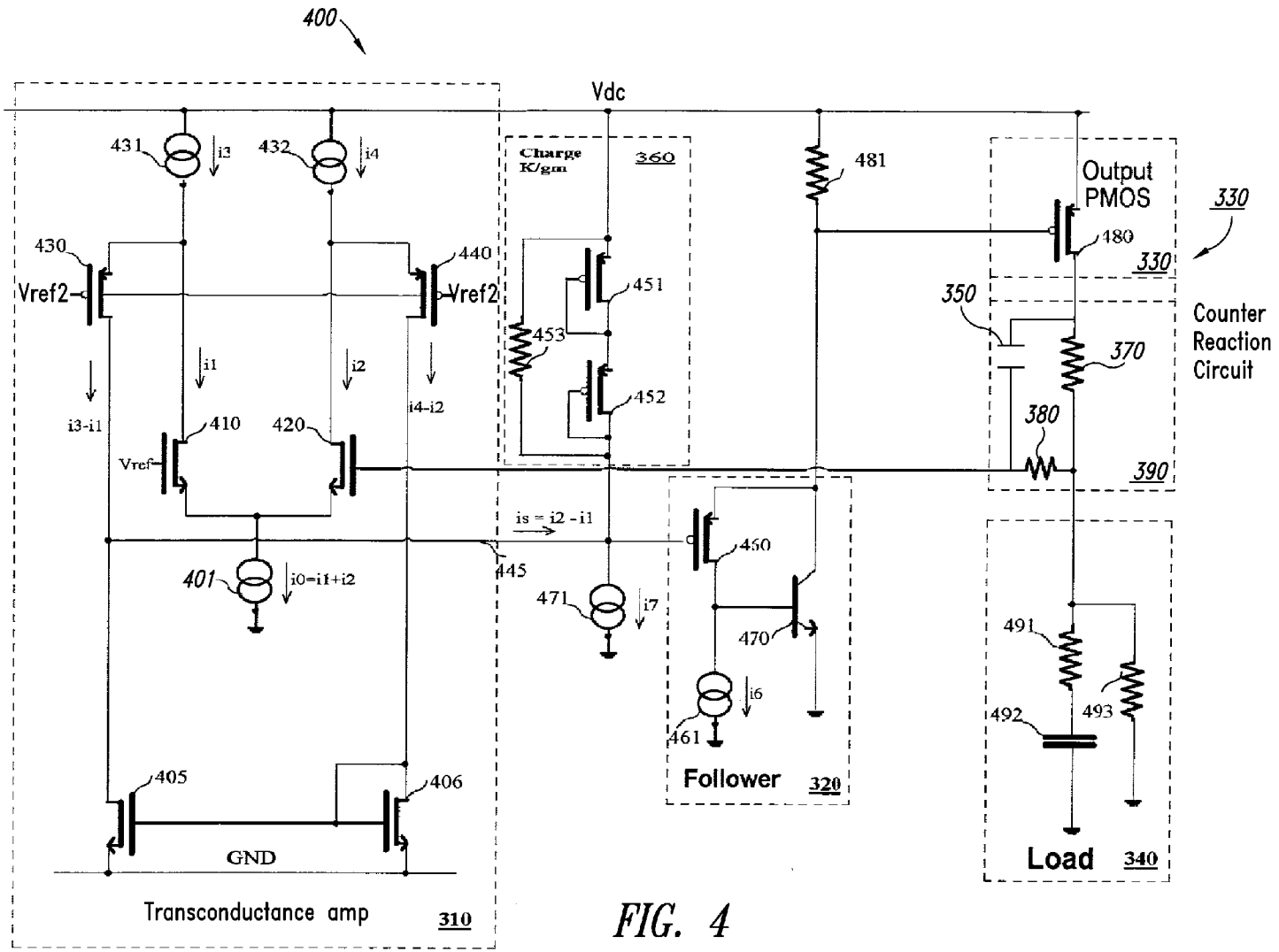
FIG. 4 illustrates a particular embodiment of a regulator complying with the principle in FIG. 3.

FIG. 4 illustrates a particular regulation circuit 400 according to an illustrated embodiment. The circuit 400 will be described with reference to the use of a PMOS transistor for the output stage, it being understood that those skilled in the art could easily adapt the circuit to make a dual structure based on an NMOS transistor for the output stage.

The regulation circuit 400 comprises a transconductance amplifier 310 based on a differential pair, a first NMOS transistor 410 and a second NMOS transistor 420, each comprising a gate, a source and a drain. The sources of the two transistors 410 and 420 are connected to a current source 401 in which there is a current i0 circuit equal to:

$$i0=i1+i2$$

where i1 and i2 are equal to the currents circulating between the source and the drain electrodes respectively of transistors 410 and 420.

The drain of transistor 410 is connected to a source of a third PMOS type transistor 430, and to a current source 431 generating a current i3.

The drain of transistor 420 is connected to a source of a fourth transistor 440 (also of a PMOS type) and to a current source 432 generating a current i4.

In practice, the values of currents i3 and i4 can be fixed equal to 4 μA.

The PMOS transistor 430 is provided with a gate into which a reference potential Vref2 is input and a drain connected to the drain of a fifth MOS transistor 405 (NMOS type) for which the source is connected to a reference potential such as the ground.

The PMOS transistor 440 is provided with a gate into which the reference potential Vref2 is also input and it comprises a drain connected to the drain of a sixth MOS transistor 405 (NMOS type) for which the source is connected to the ground. The drain of the NMOS transistor 406 is also connected to the gate of this same transistor 406 and to the gate of the transistor 405. The transistor 406 thus forms a current mirror with the transistor 405, so that the following equation between the currents is satisfied:

i4−i2=i3−i1−is, where is is the output current from the electrode 445.

If i3=i4 is fixed, we have is=i2−i1.

Therefore the drain electrode of transistors 430 and 405 outputs the output current i2−i1 from the transconductance amplifier and forms the output electrode 445 of the error amplifier stage.

The output electrode 445 is connected to the power supply potential (Vdc) to be regulated through the resistive load 360 with a profile in K/gm. The electrode 445 is also connected to an electrode of a current source 471 generating a current i7, and to the input of a follower stage 320.

The follower stage 320 consists of a seventh PMOS transistor 460 for which the gate is connected to the output electrode 445 from the transconductance amplifier 310. The drain of transistor 460 is connected to a sixth current source 461 generating a current i6 and to the base of a bipole transistor 470, the emitter of which is connected to the ground potential. The source of transistor 460 and the collector of the bipole transistor 470 are connected firstly to a first electrode of a resistance 481 and secondly to the gate of an eighth MOS transistor (PMOS type) forming the output transistor from the regulation circuit. The resistance 481 has a second electrode connected to the Vdc potential, to which the source of the transistor 480 is also connected. Finally, the transistor 480 comprises a drain generating the regulated output potential which is transmitted to the gate of the transistor 420 through the counter reaction network 490, and also to the load 340 composed of a capacitive load 492 and to resistive loads 491 and 493, as shown in FIG. 4.

The resistive load 360 connected between the potential Vdc and the output electrode 445 from the transconductance amplifier consists of a set of two PMOS transistors 451 and 452 connected in series, each having a gate and a drain connected together. In this way, a resistive load is made around a potential equal to 2× Vgs which corresponds perfectly to the offset introduced by the seventh transistor 460 and the eighth transistor 480.

The result is a resistive set with a profile in K/gm and that gives a temperature and load variation profile corresponding to that of the regulator, particularly the differential pair 410-420, but also the PMOS output transistor 480.

Optionally, a connection is made in parallel on the two MOS transistors mounted in series on a fixed resistance 453, which forms a stop to further limit the gain of the error amplifier stage 310.

The polarization current of the PMOS transistors 451 and 452 is output by a seventh current source 471 generating a current i7 so as not to disturb operation of the differential pair 410 and 420.

In one variant embodiment, it would be possible to invert the type of all transistors and to make a regulation with an NMOS type output transistor.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A voltage regulation circuit intended to generate a regulated voltage for an electronic device, the voltage regulation circuit comprising:

a transconductance amplifier having a gain of K and a transconductance coefficient of gm, said transconductance amplifier comprising a pair of MOS transistors and a resistive component having a profile of approximately K/gm, said resistive component connected to a first power supply potential, said transconductance amplifier having a first input onto which a first reference potential is applied, a second input onto which a counter reaction of said regulated voltage is applied, and an output;

a follower stage connected to the output electrode of said transconductance amplifier;

an output transistor having a source connected to said first power supply potential, wherein said output transistor is a MOS transistor.

2. A circuit according to claim 1, wherein said output transistor is a PMOS transistor with said source being connected to a positive power supply potential, and wherein said resistive component comprises at least a MOS transistor connected to provide a resistive load.

3. A circuit according to claim 2, wherein said resistive component further includes a fixed resistance in parallel to the at least one MOS transistor, said fixed resistance acting as a stop.

4. A circuit according to claim 1 wherein the pair of MOS transistors includes a first MOS transistor and a second MOS transistor;

the first MOS transistor having a gate, source and drain, with the first reference potential being input to the gate, and the source being connected to a first current source;

the second MOS transistor having a gate, source and drain, with a fraction of the output voltage from the regulator being input to the gate through said counter reaction network, the source being connected to said first current source;

a second current source connected between said first power supply potential and the drain of said first MOS transistor;

a third current source connected between said first power supply potential and the drain of said second MOS transistor;

a third MOS transistor comprising a source connected to the drain of said first MOS transistor and to said second current source; said third transistor being provided with a gate into which a second reference potential is input;

a fourth MOS transistor comprising a source connected to the drain of said second transistor and to said third current source; said fourth transistor being provided with a gate into which the second reference potential is input;

a fifth MOS transistor with a source, a gate and a drain, said source of said fifth MOS transistor being connected to a second power supply potential, said drain of said fifth MOS transistor being connected to the drain of said third transistor, and forming the output of said transconductance amplifier;

a sixth MOS transistor with a source, a gate and a drain, said source of said sixth MOS transistor being connected to said second power supply potential, said drain of said sixth MOS transistor being connected to the drain of said fourth transistor, and to the gates of said fifth and sixth transistors.

5. A circuit according to claim 4, wherein said first, second, fifth and sixth MOS transistors are NMOS transistors, and in that said third and fourth MOS transistors are PMOS transistors.

6. A circuit according to claim 4 wherein said follower stage comprises:

a seventh MOS transistor comprising a gate, a source and a drain, said gate of said seventh transistor being connected to said output electrode of said transconductance amplifier and said drain of said seventh transistor being connected to a fourth current source;

a bipole transistor comprising a base, an emitter and a collector, the base of the bipole transistor being connected to the drain of said seventh MOS transistor, the emitter being connected to said second power supply potential, and the collector being connected to the source of said seventh MOS transistor and to a first electrode of a resistance having a second electrode connected to said first power supply potential.

7. A circuit according to claim 6, wherein said output transistor comprises a gate, a source and a drain, said gate being connected to said first electrode of said resistance, said source being connected to said first power supply potential, and said drain being connected to said counter reaction circuit.

8. A circuit according to claim 4, wherein each of the third and fourth MOS transistors include a bulk electrode, wherein the bulk electrode of the third MOS transistor is connected to the bulk electrode of the fourth MOS transistor.

9. An apparatus according to claim 8 wherein said MOS transistor is a PMOS transistor, wherein said power supply potential being connected to said source of said PMOS transistor applies a positive potential to said source, and said resistive load comprises at least one MOS transistor connected in resistive load.

10. A portable communication apparatus comprising a voltage regulation circuit that includes:

a transconductance amplifier based on a pair of MOS differential transistors, said amplifier comprising a first input into which a reference potential is input and a second input into which a counter-reaction of said regulated voltage is input;

a follower stage connected to the output of said transconductance amplifier;

a MOS transistor that outputs a regulated voltage, the MOS transistor comprising a source, a drain, and a gate, the source of the MOS transistor connected to a power supply potential; wherein said transconductance amplifier comprises a resistive load with a profile in K/gm, where gm corresponds to the transconductance coefficient of said differential input pair, said resistive load being connected to said first power supply potential.

11. A voltage regulation circuit comprising:

an output transistor having a control terminal, a first conduction terminal, and a second conduction terminal;

a counter reaction circuit connected to the first conduction terminal of the output transistor;

a transconductance amplifier having a gain of K and a transconductance coefficient of gm, the transconductance amplifier having a first input, a second input, and an output, the first input having a reference potential applied thereto, the second input being coupled to the counter reaction circuit, the output being coupled to the control terminal of the output transistor; and a resistive component connected to the output of the transconductance amplifier and connected to the second conduction terminal of the output transistor, wherein the resistive component has a profile that is approximately K/gm.

12. A voltage regulation circuit according to claim 11, wherein the output transistor is a MOS transistor, and wherein the resistive component is connected to the source of the output transistor.

13. A voltage regulation circuit according to claim 11 wherein the counter reaction circuit includes:

a capacitive element; and a pair of resistive elements that are electrically arranged in series, wherein the pair of resistive elements are electrically arranged in parallel to the capacitive element.

14. A voltage regulation circuit according to claim 13, further comprising:

a load circuit connected to the serially arranged pair of resistive elements at a connection point that is between the pair of resistive elements.

15. A voltage regulation circuit according to claim 11, further comprising:

a follower stage having a first electrode connected to the output electrode of the transconductance amplifier and to the resistive component and a second electrode connected to the gate of the output transistor.

16. A voltage regulation circuit according to claim 15, further comprising:

a power supply connected to the resistive component and to either the source electrode or the drain electrode of the output transistor, wherein the resistive component and the power supply are connected to the same electrode of the output transistor.

17. A voltage regulation circuit according to claim 15 wherein the resistive component includes at least two MOS transistors serially arranged.

18. A voltage regulation circuit according to claim 17 wherein the resistive component includes a resistive element in parallel to the at least two MOS transistors.

19. A method of regulating voltage, the method comprising:

applying a first reference potential to a first electrode of a differential amplifier, the differential amplifier having a transconductance coefficient of gm and a gain of K;

applying a portion of a regulated output potential to a second input electrode of the differential amplifier;

providing an output of the differential amplifier to a follower component; and limiting the output of the differential amplifier with a resistive component connected to an output of the differential amplifier and connected to a first electrode of an output transistor, wherein a second electrode of the output transistor is connected to the second electrode of the differential amplifier, and wherein a gate of the output transistor is coupled to an output of the follower component.

20. The method of claim 19, further comprising:

selecting the resistive component such that the resistive component has a profile corresponding to approximately to K/gm.

21. The method of claim 19, further comprising:

applying a second reference potential to an electrode of the resistive component and to the second electrode of the output transistor.

* * * * *